US007367264B2

(12) United States Patent
Beaudry

(10) Patent No.: US 7,367,264 B2
(45) Date of Patent: May 6, 2008

(54) METHOD AND APPARATUS FOR TREATING SHEETS INCLUDING A VACUUM ROLLER FOR RETAINING SHEETS IN CURVED CONFIGURATION

(76) Inventor: Wallace J. Beaudry, N9330 County Highway H, Elkhart Lake, WI (US) 53020

( * ) Notice: Subject to any disclaimer, the term of this patent is extended or adjusted under 35 U.S.C. 154(b) by 51 days.

(21) Appl. No.: 10/903,894

(22) Filed: Jul. 30, 2004

(65) Prior Publication Data

US 2006/0021534 A1 Feb. 2, 2006

(51) Int. Cl.
*B65H 5/12* (2006.01)

(52) U.S. Cl. ..... 101/409; 427/294; 118/500; 162/370; 101/246

(58) Field of Classification Search ..... 101/389.1, 101/415.1, 409; 271/276, 96, 112; 226/95; 162/368, 369, 370, 371; 492/16–20, 22, 492/24–26, 32, 48
See application file for complete search history.

(56) References Cited

U.S. PATENT DOCUMENTS

| | | | | | |
|---|---|---|---|---|---|
| 712,664 | A | | 11/1902 | Gage | 162/371 |
| 1,025,822 | A | * | 5/1912 | Millspaugh | 162/266 |
| 1,800,149 | A | * | 4/1931 | Guyon et al. | 162/371 |
| 1,812,812 | A | | 6/1931 | Street | 162/371 |
| 1,821,793 | A | | 9/1931 | Conley | 162/369 |
| 2,094,348 | A | | 9/1937 | Carlson | 427/211 |
| 2,929,450 | A | | 3/1960 | Kurz | 162/370 |
| 2,969,837 | A | | 1/1961 | Reynar | 162/371 |
| 3,013,487 | A | * | 12/1961 | Faeber | 101/181 |
| 3,019,130 | A | | 1/1962 | Hornbostel | 427/296 |
| 3,037,557 | A | | 6/1962 | Faeber et al. | 226/95 |
| 3,043,370 | A | | 7/1962 | Ostertag, Jr. et al. | 162/344 |
| 3,142,428 | A | | 7/1964 | Faeber | 226/95 |
| 3,265,559 | A | | 8/1966 | Means | 162/276 |
| 3,300,374 | A | | 1/1967 | Baker et al. | 162/276 |
| 3,455,274 | A | * | 7/1969 | Modersohn | 118/62 |
| 3,533,618 | A | * | 10/1970 | Carstens | 271/276 |
| 3,684,627 | A | | 8/1972 | Hottendorf | 156/578 |
| 4,058,435 | A | | 11/1977 | Williams, Jr. | 162/371 |
| 4,064,288 | A | | 12/1977 | Shah et al. | 427/58 |
| 4,761,309 | A | | 8/1988 | Embry | 427/294 |
| 5,137,758 | A | | 8/1992 | Kistner et al. | 427/350 |
| 5,152,872 | A | * | 10/1992 | Racine et al. | 162/184 |
| 5,360,481 | A | * | 11/1994 | Ludwig | 118/50 |
| 5,464,289 | A | | 11/1995 | Beaudry | 400/62 |
| 5,580,424 | A | | 12/1996 | Snellman | 162/371 |
| 5,618,584 | A | | 4/1997 | Schaede | 427/336 |
| 6,110,282 | A | | 8/2000 | Tateyama et al. | 118/712 |
| 6,247,861 | B1 | * | 6/2001 | Wotton | 400/636.3 |
| 6,254,732 | B1 | | 7/2001 | Savolainen | 162/371 |
| 6,454,405 | B1 | | 9/2002 | Stowe | 347/102 |
| 6,551,654 | B1 | | 4/2003 | Branch et al. | 427/208 |
| 6,585,139 | B1 | * | 7/2003 | Holtmann et al. | 226/95 |
| 6,608,987 | B2 | | 8/2003 | Bartscher et al. | 399/336 |

FOREIGN PATENT DOCUMENTS

JP 64-81731 * 3/1989

* cited by examiner

*Primary Examiner*—Leslie J. Evanisko
(74) *Attorney, Agent, or Firm*—Ryan Kromholz & Manion, S.C.

(57) ABSTRACT

An apparatus and method for retaining individual sheets of substrate in a curved configuration during coating or printing is disclosed.

26 Claims, 16 Drawing Sheets

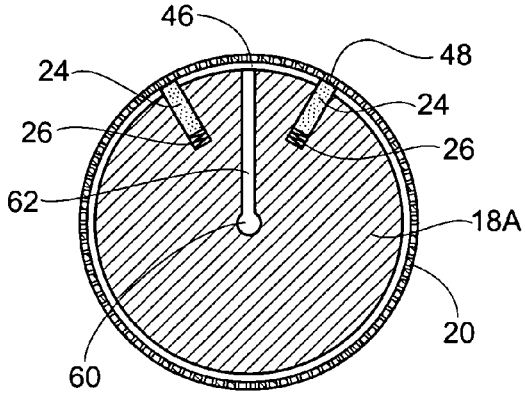
Fig. 7
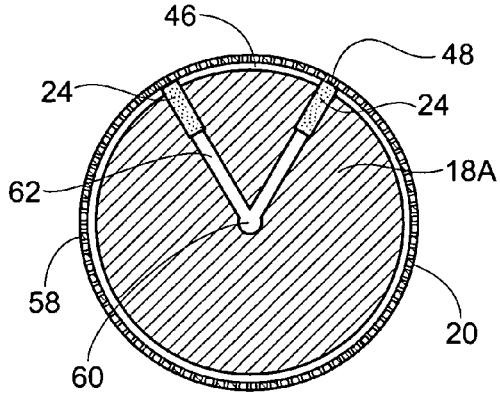
Fig. 8
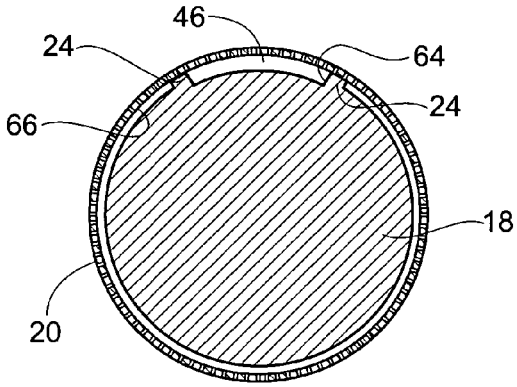
Fig. 9
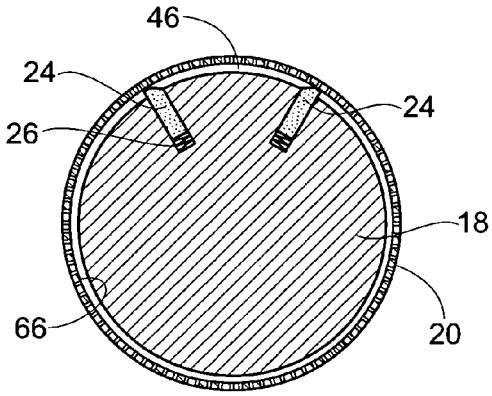
Fig. 10
Fig. 11B
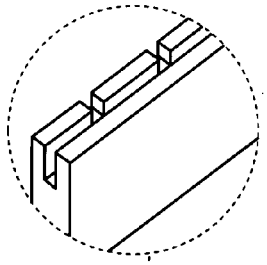
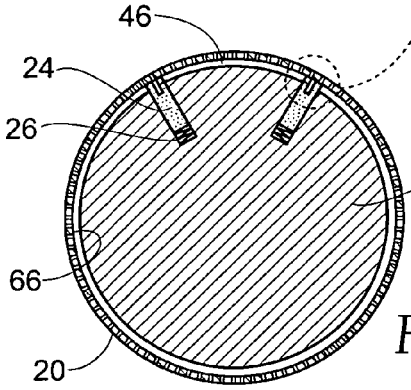
Fig. 11A
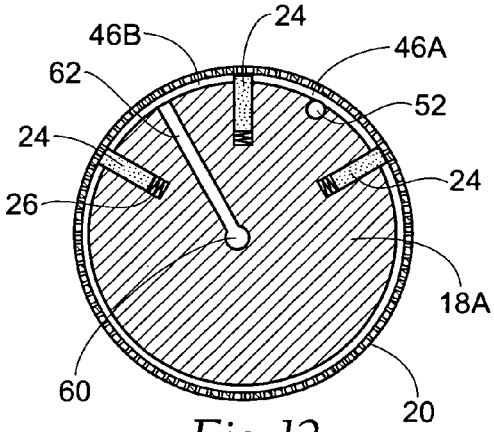
Fig. 12

METHOD AND APPARATUS FOR TREATING SHEETS INCLUDING A VACUUM ROLLER FOR RETAINING SHEETS IN CURVED CONFIGURATION

BACKGROUND OF THE INVENTION

The present invention relates generally to an apparatus and method for retaining individual sheet substrates, especially paper or cardboard in a curved configuration during printing or while applying coating material, such as UV-curable coating.

It is often desirable to coat printed substrates, such as paper or cardboard, to thereby protect the printed surface from smudging and water damage. Particularly durable coatings of this type are those cured by exposure to UV rays. Typically, the substrate surface to be coated is dropped onto a conveyor where it moves toward a coating station having a fountain system, for example. The fountain system may include a continuous coating surface, such as a coating/transfer roller for applying a coating. If UV curable coating is to be used, the coated substrate is moved away from the coating station and toward a UV source where it is exposed to UV radiation for a predetermined amount of time to thereby cure the coating. Present methods and devices for coating substrates are typically designed for coating continuous webs of substrate dispensed from a roll, for example. Such processes and devices cannot easily accommodate individual sheets of substrate.

It is sometimes desirable to apply coatings to cut, individual sheets of substrate, rather than to a continuous web of material. A particular problem associated with the application of certain coatings, such as UV curable coatings, to individual sheets is the tendency of sheet substrates of lesser thicknesses to curl at the edges during coating. Further, it has been observed that individual sheets tend to adhere to the transfer roller during coating and do not release properly after coating. Similar problems have also been observed during printing, particularly printing of individual sheets having a relatively small thickness. Various means of correcting these problems have been utilized. For example, mechanical "fingers" may be used to hold the corners of the sheet substrate flat during coating. However, this solution has been found to be unacceptable, particularly in situations requiring the substrate to be completely coated, since the coating cannot reach the points of "finger" contact. Another unacceptable solution has been use of a flat vacuum conveyer. In this case, as an individual sheet substrate moves past the transfer roller, a vacuum through the conveyer holds the sheet flat and against the conveyer thereby preventing the sheet from adhering to the transfer roller. However, depending upon the thickness of the sheet substrate, undesirable "dimpling" may occur, caused by the sheet substrate being drawn into the apertures in the conveyor by the vacuum. Therefore, an improved method and apparatus for transferring coating from a transfer surface to individual sheets of substrate is desired.

SUMMARY OF THE INVENTION

The present invention offers a solution to the above-mentioned problems. A vacuum roller provides an exemplary apparatus and method for facilitating the consistent retention of individual sheets of substrate in a curved configuration during application of coating material, or alternatively during printing. The vacuum roller attracts and retains each sheet in a curved configuration while a continuous transfer surface transports coating or printing material into contact with the individual sheet of substrate. The vacuum roller apparatus is particularly useful in connection with individual sheets having the tendency to adhere to the transfer surface during and after coating. A preselected coating or printing material may be applied to the transfer surface via a fountain system or other suitable means capable of applying various types of coating or printing material at various thicknesses and variable patterns to a continuous transfer surface. Coating material to be used may include UV curable coating, by way of non-limiting example. The transfer surface preferably cooperates with a vacuum roller according to the present invention to provide a nip between which an individual sheet substrate passes during coating or printing, while the vacuum roller retains each sheet in a curved configuration. It is to be noted that the present invention may be used in any of various applications employing a kiss impression on a tangent during printing or coating. Further, the vacuum roller attracts and retains the leading edge of individual sheets as they enter the nip formed between the vacuum roller and the transfer surface thereby exerting directional control over each sheet. A vacuum roller according to the present invention may also be used to retain a printing plate in a curved configuration during printing.

One embodiment of a vacuum roller according to the present invention includes (a) a stationary supporting shaft, (b) a rotatable sleeve member, at least a portion of the rotatable sleeve member being circumjacent to the supporting shaft, the rotatable sleeve member including a plurality of perforations arranged in a predetermined pattern, (c) the supporting shaft further including at least a pair of radially extending, spaced apart barrier members extending longitudinally of the perforation pattern to thereby provide a chamber, which may be used for evacuating or pressurizing, depending on specified operational parameters, (d) a source of reduced pressure/vacuum communicating with the chamber for providing an area of reduced pressure over a portion of the sleeve member positioned closest to a transfer surface, effective for attracting the sheets to the sleeve member and retaining individual sheets of substrate in a curved configuration as sheets are coated or printed by a continuous transfer surface and are moved away from the transfer surface.

The method includes the ordered steps of: (i) conveying sheets of substrate material along a sheet path and in a machine direction, (ii) providing a coating or printing material, such as a UV curable coating, (iii) providing a continuous transfer surface used to transport coating or printing material into contact with each individual sheet, (iv) providing a vacuum roller including: a stationary supporting shaft, a rotatable sleeve member, at least a portion of the sleeve member being circumjacent to the supporting shaft, the rotatable sleeve member including a plurality of perforations arranged in a predetermined pattern, and a pair of radially extending, circumferentially spaced barrier members extending longitudinally of the perforation pattern to provide a chamber, (v) providing a source of reduced pressure/vacuum communicating with the chamber to provide an area of reduced pressure over the portion of the sleeve member positioned closest to the transfer surface effective for attracting the sheets to the sleeve member and retaining individual sheets of substrate in a curved configuration as sheets are coated by a continuous transfer surface and are moved away from the transfer surface.

An alternative embodiment of the vacuum roller includes (a) a rotatable supporting shaft, (b) a rotatable sleeve member, at least a portion of the rotatable sleeve member being circumjacent to the supporting shaft, the rotatable sleeve member including a plurality of perforations arranged in a predetermined pattern, (c) the supporting shaft further including at least a pair of radially extending, circumferentially spaced barrier members extending longitudinally of the perforation pattern to thereby provide a chamber, (d) a source of reduced pressure/vacuum communicating with the chamber for providing an area of reduced pressure over a portion of the sleeve member positioned closest to the transfer surface, effective for attracting the sheets to the sleeve member and retaining individual sheets of substrate in a curved configuration as sheets are coated or printed by a continuous transfer surface and are moved away from the transfer surface.

An alternative method includes the ordered steps of: (i) conveying sheets of substrate material along a sheet path and in a machine direction, (ii) providing a coating or printing material, such as a UV curable coating, (iii) providing a continuous transfer surface used to transport coating or printing material into contact with each individual sheet, (iv) providing a vacuum roller including: a rotatable supporting shaft, a rotatable sleeve member, at least a portion of the sleeve member being circumjacent to the supporting shaft, the rotatable sleeve member including a plurality of perforations arranged in a predetermined pattern, and at least a pair of radially extending, spaced apart barrier members extending longitudinally of the perforation pattern to provide a chamber, (v) providing a source of reduced pressure/vacuum communicating with the chamber to provide an area of reduced pressure over the portion of the sleeve member positioned closest to the transfer surface effective for attracting the sheets to the sleeve member and retaining individual sheets of substrate in a curved configuration as sheets are coated or printed by a continuous transfer surface and are moved away from the transfer surface.

The unique transfer roll and vacuum roll combination of the present invention provides an apparatus and method effective for coating or printing at least one major portion of individual sheets of a substrate with a coating. One embodiment of the apparatus includes (i) a sheet feeder operable to feed individual sheet substrate onto a conveyor, (ii) conveying means to move the sheet substrate along a sheet path, (iii) a coating/transfer mechanism and vacuum roller positioned in cooperating relationship to receive the sheet substrate from the conveyor and operable to apply coating or printing material to at least one major portion of each sheet, the vacuum roller including a supporting shaft, a rotatable sleeve member, at least a portion of the sleeve member being circumjacent to the supporting shaft, the rotatable sleeve member including a plurality of perforations arranged in a predetermined pattern, and at least a pair of radially extending, spaced apart barrier members extending longitudinally of the perforation pattern to provide a chamber, and, optionally, (iv) a source of UV radiation positioned along the sheet path for curing UV curable coating applied to the sheets by the coating/transfer mechanism and vacuum roller.

The method comprises the ordered steps of: (a) feeding individual sheet substrates onto a sheet path, (b) conveying the sheets along a sheet path, (c) providing a coating/transfer roller and vacuum roller positioned in cooperating relationship to receive the sheet substrate, whereby coating or printing material is applied to at least one major portion of each sheet as the sheets continue to be conveyed along the sheet path, the vacuum roller including a supporting shaft, a rotatable sleeve member, at least a portion of the sleeve member being circumjacent to the supporting shaft, the rotatable sleeve member including a plurality of perforations arranged in a predetermined pattern, and at least a pair of radially extending, spaced apart barrier members extending longitudinally of the perforation pattern to provide a chamber, and optionally, (d) curing UV curable coating applied to each sheet while continuing to convey the sheets along the sheet path.

Yet another embodiment of the vacuum roller includes (a) a hollow supporting shaft, (b) a sleeve member, at least a portion of the sleeve member including a plurality of perforations arranged in a predetermined pattern, (c) a source of reduced pressure/vacuum communicating with the hollow, rotatable shaft for providing an area of reduced pressure over the portion of the sleeve member which includes perforations, effective for attracting a printing plate or flexographic printing die to the sleeve member and retaining it in a curved configuration during printing.

The present invention also comprises a vacuum roller including a supporting shaft; a sleeve member, at least a portion of the sleeve member being circumjacent to the supporting shaft; the sleeve member including a plurality of perforations; the supporting shaft further including a chamber; the perforations communicating with the chamber; the chamber being supplied with a source of reduced pressure; and a sheet of substrate, the sheet of substrate being held in a curved configuration against the sleeve member by the reduced pressure.

The present invention further includes the alternative method for retaining a substrate in a curved configuration comprising the steps of: (a) providing a vacuum roller, the vacuum roller including a supporting shaft and a sleeve member; (b) providing at least a portion of the sleeve member with a plurality of perforations arranged in a predetermined pattern; (c) positioning at least a portion of the sleeve member circumjacent to the supporting shaft; (d) providing the supporting shaft with a chamber, the chamber being in communication with the perforations; (e) providing a sheet of substrate; (f) applying a source of reduced pressure to the chamber so as to attract the sheet of substrate to the sleeve member and against the perforations; (g) retaining said sheet of substrate in a curved configuration.

The present invention further provides an apparatus for treating a surface area of a web with a predetermined material, the apparatus comprising: a vacuum roller, the vacuum roller including a supporting shaft and a sleeve member, at least a portion of the sleeve member being circumjacent to the supporting shaft, the sleeve member including a plurality of perforations arranged in a predetermined pattern, the supporting shaft further including a chamber therein; an anvil roller, the anvil roller and the vacuum roller cooperating to form a nip therebetween; a source of reduced pressure, the source of reduced pressure communicating with the chamber.

The present invention further includes a method for producing printed webs, the method comprising the steps of: (a) sequentially feeding a web having a first side and a second, oppositely disposed side onto a web path and conveying the web along the web path in a machine direction; (b) providing a vacuum roller and anvil roller in cooperating relationship so as to form a nip, the vacuum roller including a rotatable supporting shaft and a sleeve member, at least a portion of said sleeve member being circumjacent to the rotatable supporting shaft, the sleeve member including a plurality of perforations arranged in a predetermined pattern, the rotatable supporting shaft further including a chamber; (c) providing a printing plate; (d) applying a source of reduced pressure to the chamber so as to attract the printing plate to the sleeve member; (e)

inserting a web into the nip; and (f) retaining the printing plate in a curved configuration while printing the web to provide a printed web.

The present invention further includes a method for printing, the method comprising the steps of: (a) conveying a web along a sheet path in a machine direction; (b) providing a vacuum roller and anvil roller in cooperating relationship so as to form a nip, the vacuum roller including a hollow, rotatable supporting shaft and a sleeve member, at least a portion of the sleeve member being circumjacent to the hollow, rotatable supporting shaft, the sleeve member including a plurality of perforations arranged in a predetermined pattern, the hollow, rotatable supporting shaft further including a vacuum chamber; (c) providing a flexible printing plate; (d) inserting a leading edge of thee web into the nip; (e) applying a source of reduced pressure to the chamber so as to attract the flexible printing plate to the sleeve member; and (f) retaining the printing plate in a curved configuration during printing of the web to provide a printed web.

BRIEF DESCRIPTION OF THE DRAWINGS

FIG. 7 is a cross section of the vacuum roller illustrated in FIG. 6, taken along lines 7-7, thereof and showing the hollow shaft used in combination with channels to supply reduced pressure to the chamber, with barrier members being spring biased.

FIG. 8 cross sectional view, similar to that of FIG. 7, but showing an alternative embodiment wherein the hollow supporting shaft and channels supply increased pressure to thereby bias the barrier members by way of pressure.

FIG. 9 is a cross sectional view, similar to those of FIGS. 7-8, but showing a solid shaft with barrier members being integrally formed as a one piece construction therewith.

FIG. 10 is a cross sectional view, similar to those of FIGS. 7-9, but showing a solid shaft with barrier members having chamfered contact surfaces.

FIG. 11A is a cross sectional view, similar to those of FIGS. 7-10, but showing a solid shaft with barrier members having baffled areas.

FIG. 11B is an enlarged perspective view of a barrier member as illustrated in FIG. 11A.

FIG. 12 cross sectional view, similar to those of FIGS. 7-11, but showing an alternative embodiment vacuum roller having spring biased barrier members defining two chambers, one supplied with a source of reduced pressure/vacuum and the other a source of increased pressure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

As utilized herein, including the claims, the term "vacuum", in addition to its common meaning, refers to any pressure less than atmospheric and possessing sufficient attractive force to achieve the desired retention of sheet substrate.

As seen in the various drawing Figures, the apparatus may be designed for use during the coating or printing of individual sheets of substrate, such as, for example, paper or cardboard, or any other suitable substrate.

Figure 2A:
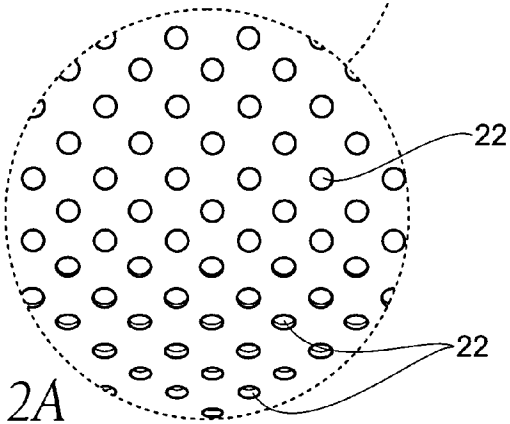
FIG. 2A is an enlarged view of a portion of the rotatable sleeve and showing a predetermined perforation pattern.
Figure 3:
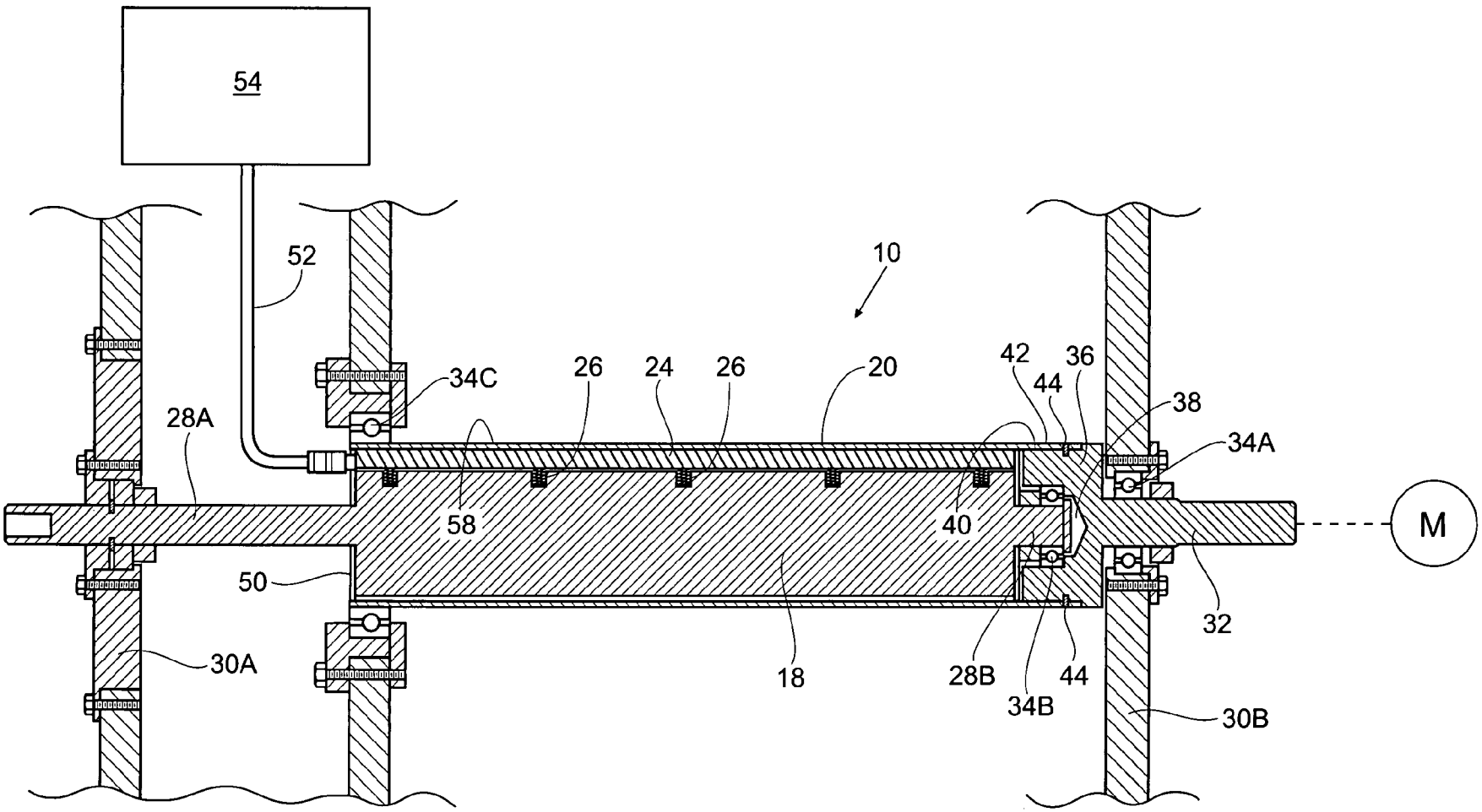
FIG. 3 is a longitudinal section of the vacuum roller of FIG. 2 and taken along lines 3-3 thereof.
Figure 4:
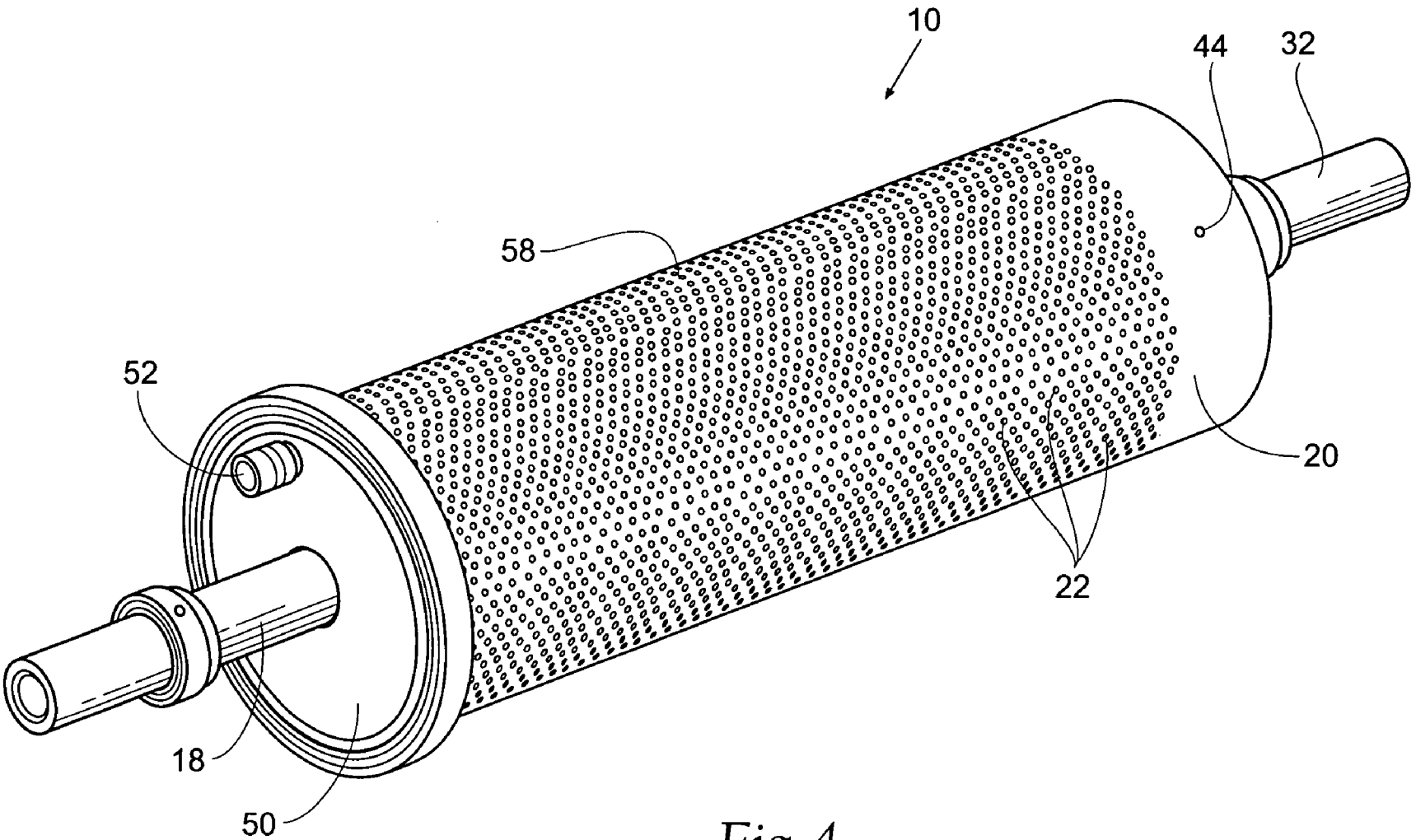
FIG. 4 is a perspective view of a vacuum roller according to the present invention.
Figure 5:
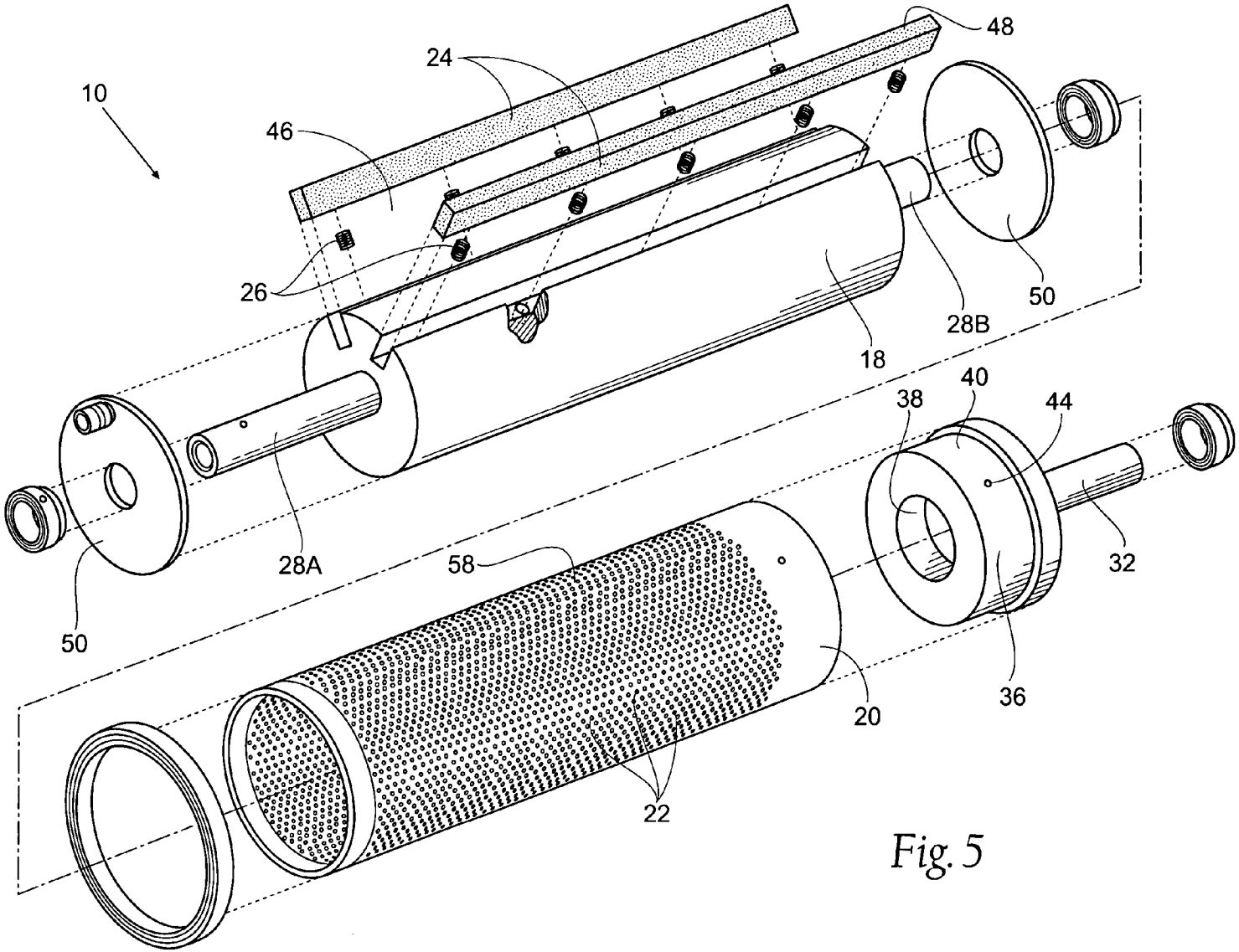
FIG. 5 is an exploded view of the vacuum roller illustrated in FIGS. 1-4.

As shown in FIGS. 1-5, a preferred embodiment of the novel vacuum roller 10 is shown. As seen, the vacuum roller 10 may be used in combination with a coating station 12, including a continuous coating applicator, such as the transfer roller 14 shown, and accompanying fountain system 16. The vacuum roller 10, according to the present invention, preferably includes a stationary supporting shaft 18 and a rotatable sleeve member 20. The sleeve member 20 includes a plurality of perforations/apertures 22 being arranged in a predetermined pattern, an example of which is shown in FIG. 2A. It is to be noted that the size and spacing of the perforations/apertures 22 may be varied according to the sheet substrate to be utilized. For example, smaller, closely spaced apertures 22 may be used with a substrate having a relatively small thickness, while apertures 22 of greater size may be used with sheet substrates having a relatively large thickness. Further, the preferred arrangement of the apertures 22 is staggered, as seen particularly in FIG. 2A, to thereby increase probability of secure attraction of substrate to the sleeve member 20. The supporting shaft 18 further includes at least a pair of radially extending, circumferentially spaced barrier members 24 which extend longitudinally of the perforations 22, and are normally mechanically biased outwardly, extending radially of the supporting shaft 18 and towards contact with the sleeve member 20. The barrier members 24 may be mechanically biased by way of springs 26, as shown in FIGS. 3 and 5, for example, or may be outwardly biased with other means, such as air pressure, as will be discussed with reference to FIG. 8.

As seen in FIG. 3, the shaft 18 is supported and pinned at one end 28A by a vertical member 30A and supported at its opposite end 28B by vertical support 30B. The support at vertical member 30B is provided by a rotatable shaft extension member 32, which is journalled in the vertical member 30B by means of bearings 34A and inner bearings 34B. The shaft extension member 32 includes cupped area 36, an inner portion 38 of which is adapted to receive the end 28B of the shaft 18. An outer surface 40 of the cupped area 36 is adapted to be received into an end 42 of the rotatable sleeve 20. The sleeve 20 is preferably attached by conventional means such as the set screw 44 shown, such that the sleeve 20 rotates about the shaft 18 and barrier members 24 on bearings 34C. A prime mover is supplied with motor M communicating with shaft extension 32.

Figure 2:
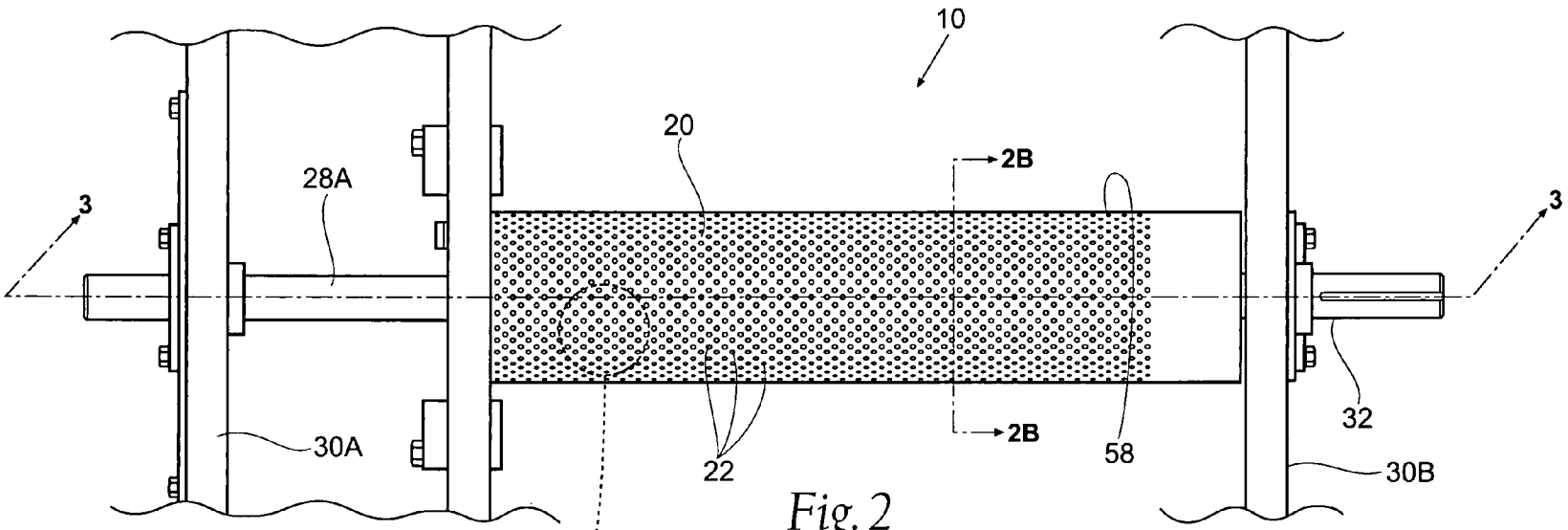
FIG. 2 is a side view of a vacuum roller according to the present invention.
Figure 2B:
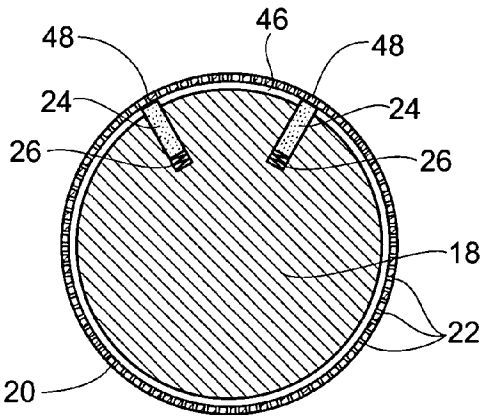
FIG. 2B is a cross sectional view of the vacuum roller illustrated in FIG. 2 and taken along lines 2B-2B thereof.

As may be seen particularly in FIGS. 5 and 2B, barrier members 24 define a chamber 46 therebetween and further provide a surface 48 on which the sleeve member 20 rides. As the sleeve member 20 rotates around the shaft 18, on barrier member surface 48, the apertures 22 communicate with the chamber 46. As illustrated, the chamber 46 is provided with end caps 50 to seal opposite ends of the defined chamber 46. As is further seen in FIG. 3, the chamber 46 may be connected by a line 52 to a vacuum source, such as a vacuum pump 54. It is to be noted that in use, the chamber 46 is preferably positioned such that an area of reduced pressure is provided over a portion of the sleeve member 20 closest to the transfer roller 14. The suction generated by the vacuum pump 54 influences each sheet 56 as it passes over the chamber 46 such that each sheet 56 is held against the outer, curved surface 58 of the sleeve 20 in a curved configuration as the transfer roller 14 coats the sheet 56 (see FIG. 15). The curved shape of each sheet 56 during coating provides the needed rigidity to minimize dimpling, while the reduced pressure inside the chamber 46 holds each sheet 56 against the outer surface 58 of the sleeve 20 so that the sheet 56 does not adhere to the transfer roller 14. It is noted that the spacing and angle of the barrier members 24 may be varied to allow variation in chamber 46 size, or sheet throw-off speed.

Figure 6:
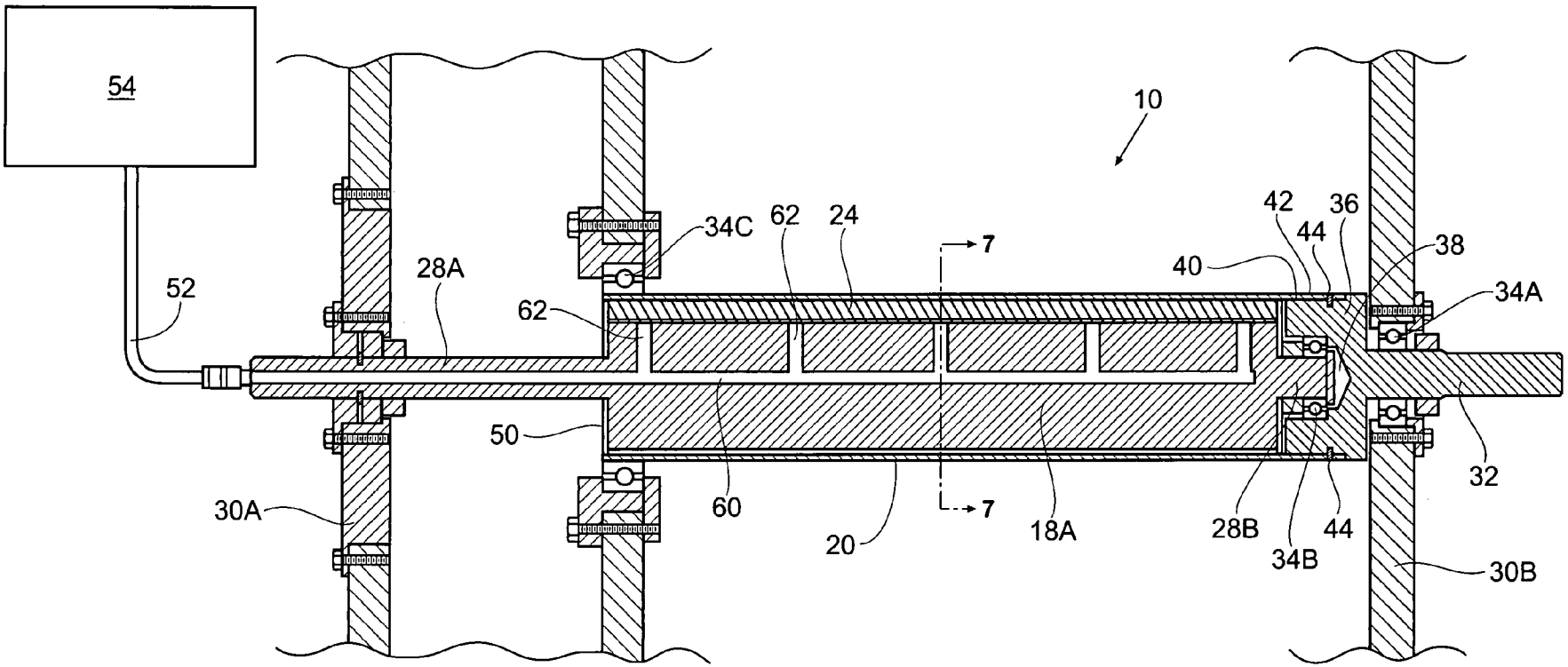
FIG. 6 is a is a longitudinal section of a vacuum roller similar to that shown in FIGS. 1-5, but showing an alternative embodiment having a hollow supporting shaft.
Figure 13:
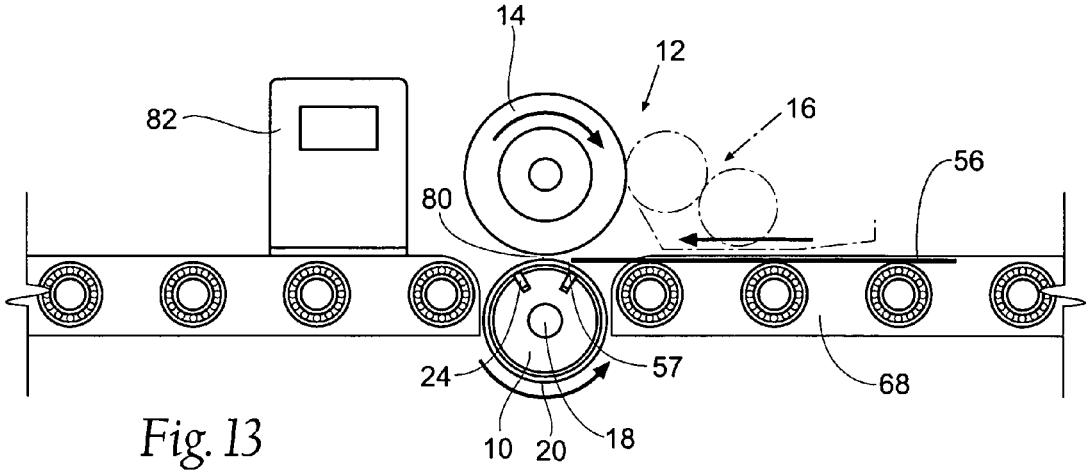
FIGS. 13-17 are diagrammatic views illustrating a method of applying a UV curable coating to individual sheets of substrate according to the present invention.

As may be seen particularly in FIG. 6 and in the cross sectional view of FIG. 7, it is within the scope of this invention to provide a vacuum roller 10 having a hollow shaft 18A. Hollow shaft 18A allows a source of reduced pressure/vacuum to be provided through the shaft 18A. As seen, shaft 18A preferably includes a bore 60 communicating with channels 62. This arrangement permits a source of reduced pressure/vacuum to communicate with the chamber 46 via channels 62 for providing an area of reduced pressure over a portion of the sleeve member 20 positioned closest to the transfer roller 14. The bore 60 may be connected by line 52 or other conventional means, to a vacuum pump 54. As in the previously discussed embodiment, the area of reduced pressure in the chamber 46 generated by the vacuum pump 54 influences each sheet 56 as it passes over the chamber 46 such that each sheet 56 is attracted to, and held against, the outer curved surface 58 of the sleeve 20 in a curved configuration as the transfer roller 14 coats the sheet 56 (see FIG. 15). The curved shape of each sheet 56 during coating provides the needed rigidity to minimize dimpling, while the vacuum holds each sheet 56 against the sleeve 20 so that the sheet 56 does not adhere to the transfer roller 14.

Alternatively, and as shown in FIG. 8, hollow shaft 18A may be provided with pressurized air. In this embodiment, the bore 60 communicates with channels 62. Channels 62 communicate with barrier members 24, rather than the chamber 46 seen in previous Figures. This arrangement provides barrier members 24 with biasing pressure as an alternative to the mechanical spring biasing seen in previous views.

Another variation in the shaft 18A structure may be seen in the cross sectional view of FIG. 12. Similarly to the arrangement shown in FIG. 7, channels 62 communicate with the chamber 46. However, three barrier members 24 are provided in this arrangement to allow two chambers 46A, 46B. This arrangement allows both reduced pressure and increased pressure to be alternatively supplied to the vacuum roller 10. As illustrated, the vacuum source may be applied via line 52, as seen in FIG. 3, with the bore 60 and channels 62 supplied with pressurized air. In this arrangement, both increased pressure and reduced pressure may be used to influence individual sheets 56. As seen, a vacuum may be supplied to chamber 46A, with chamber 46A being in alignment with transfer roller 14 during coating or printing. As an individual sheet 56 moves with the sleeve 20 and away from the transfer roller 14 after coating or printing, pressure may be supplied to the chamber 46B to thereby increase the speed at which the sheet 56 is disengaged from the sleeve 20. (e.g. sheet throw-off speed).

Sheet throw-off speed may also be influenced by changes in the surface 48 of barrier members 24. Examples of such variations may be seen in the views of FIGS. 10-11B. As illustrated in FIG. 10, the surface 48 may be chamfered. This arrangement influences the speed at which an individual sheet 56 is attracted to the vacuum roller 10 as well as the disengagement speed of the leading edge 57 after coating. FIGS. 11A and 11B illustrate a baffled construction.

The cross sectional view of FIG. 9 illustrates a machined shaft 18, which includes a top surface 64 which has been configured to include stationary barrier members 24 which function similarly to previously described biased barrier members. Barrier members 24 such as these may require additional machining techniques to ensure intimate contact between surface 48 and the inner surface 66 of sleeve 20.

Figure 1:
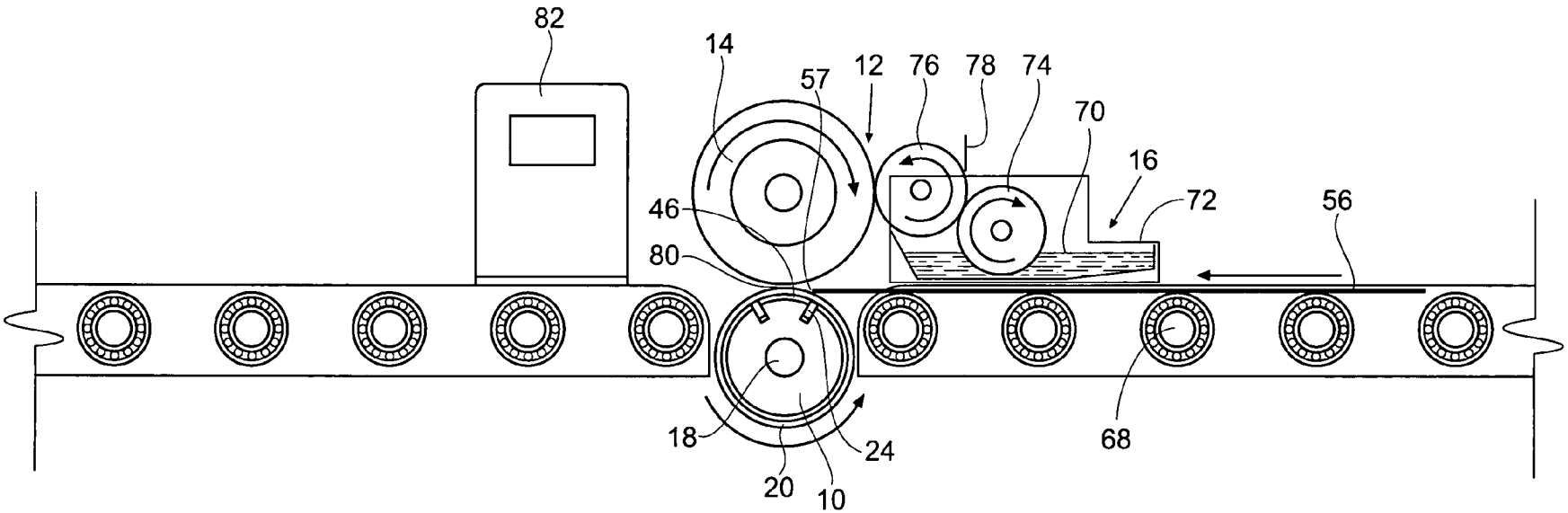
FIG. 1 is a schematic side view of an apparatus according to the present invention.
Figure 29:
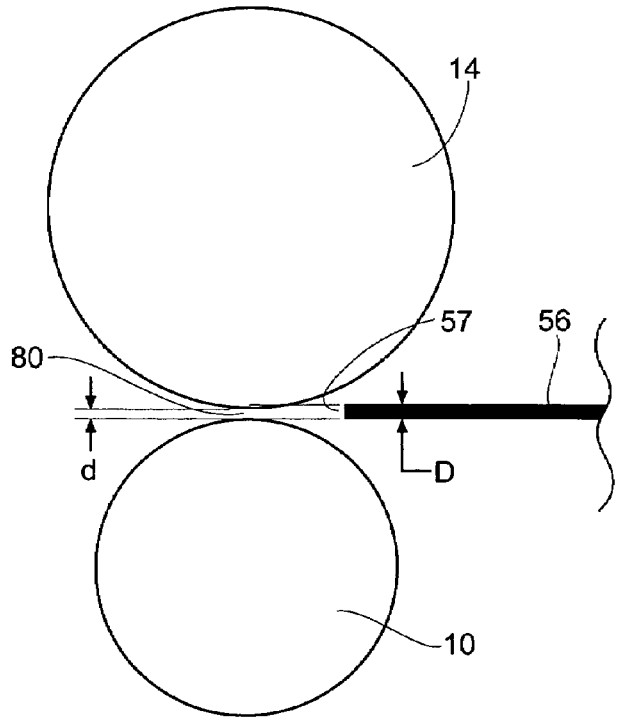
FIG. 29 is a diagrammatic view illustrating the spacing of the application surface and vacuum roller relative to a width of sheet substrate.

As is shown in FIG. 1 and in greater detail in FIGS. 13-17, a method exemplifying a use of the present invention may be seen. Individual sheets 56 of substrate are fed on a conveyor 68 and moved along a sheet path and toward a coating station 12. Printing or coating material 70, such as UV curable coating is supplied by conventional means, seen as a fountain system 16 in these views. A fountain system 16 typically includes a trough 72 containing coating material 70, a metering/doctoring roll 74 for removing the coating material 70 from the trough 72, and an anilox roll 76 and its doctoring blade 78, for receiving coating material 70 from the metering/doctoring roll 74. The anilox roll 76 transfers coating material 70 to a continuous transfer surface, such as the transfer roller 14 shown. The transfer roller 14 and vacuum roller 10 cooperate to provide a nip 80 (seen also in FIG. 29). As seen particularly in FIG. 13 and 29, nip 80 is arranged to receive a leading edge 57 of an individual sheet 56 and move it past the coating surface of transfer roller 14. It should be noted that the thickness d of the nip 80 is preferably slightly smaller than the thickness D of the sheet substrate 56 to be coated. For instance, and in particular reference to FIG. 29, it may be seen that the nip 80 is smaller than the sheet substrate 56 to allow for slight compression of the sheet substrate 56 during coating. Further, it is necessary for the nip 80 to be at least of a width to maintain separation between transfer roller 14 and sleeve 20 to thereby prevent inadvertent transfer of coating material 70 directly onto the sleeve 20. It is to be understood that while a fountain system 16 and transfer roller 14 applying a coating material 70 is shown in these views, the present invention may be utilized in a printing environment, with a printing roller applying print to the surface of a sheet substrate 56. Further, while the nip 80 is illustrated in these views as continuous, an intermittent nip, as for example in a printing application wherein the print material is to be applied to a portion of the sheet substrate 56, is within the scope of this invention.

Figure 14:
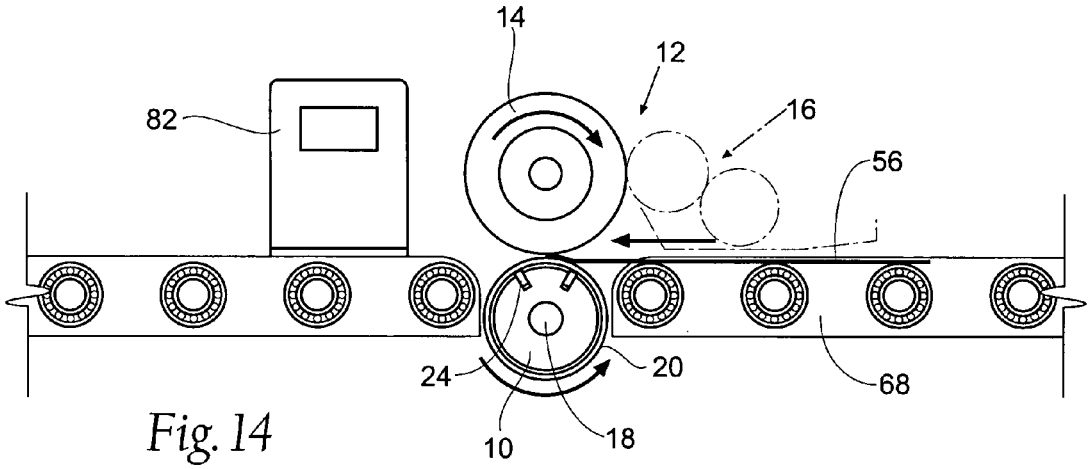
Figure 15:
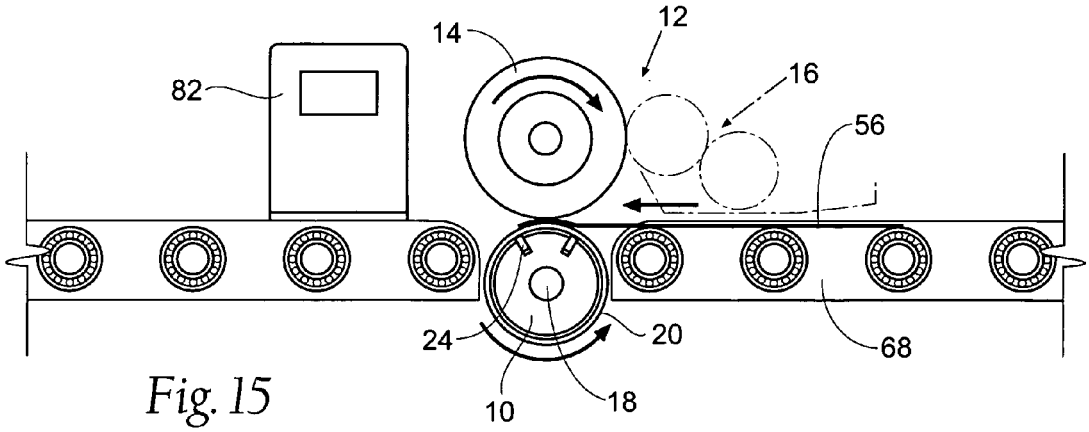
Figure 16:
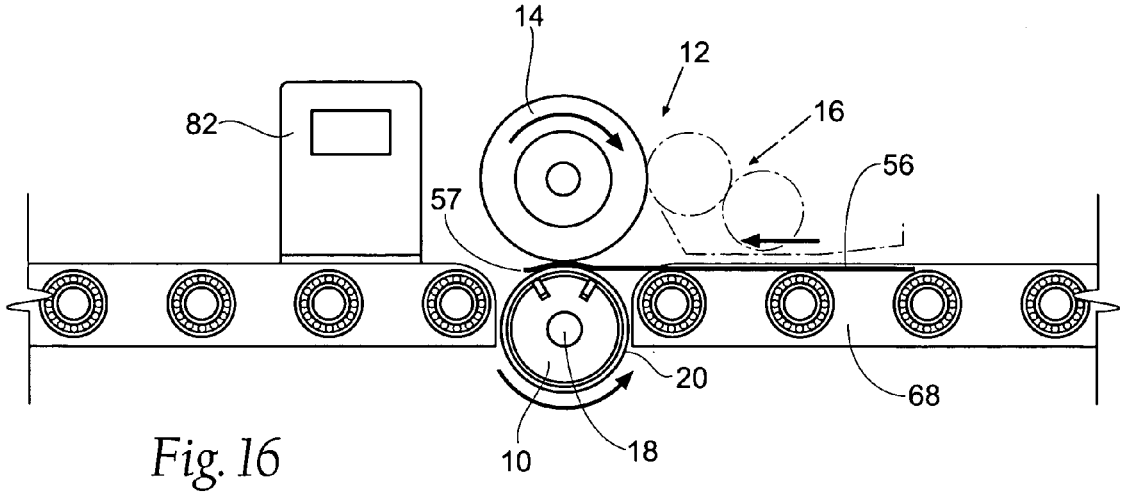
Figure 17:
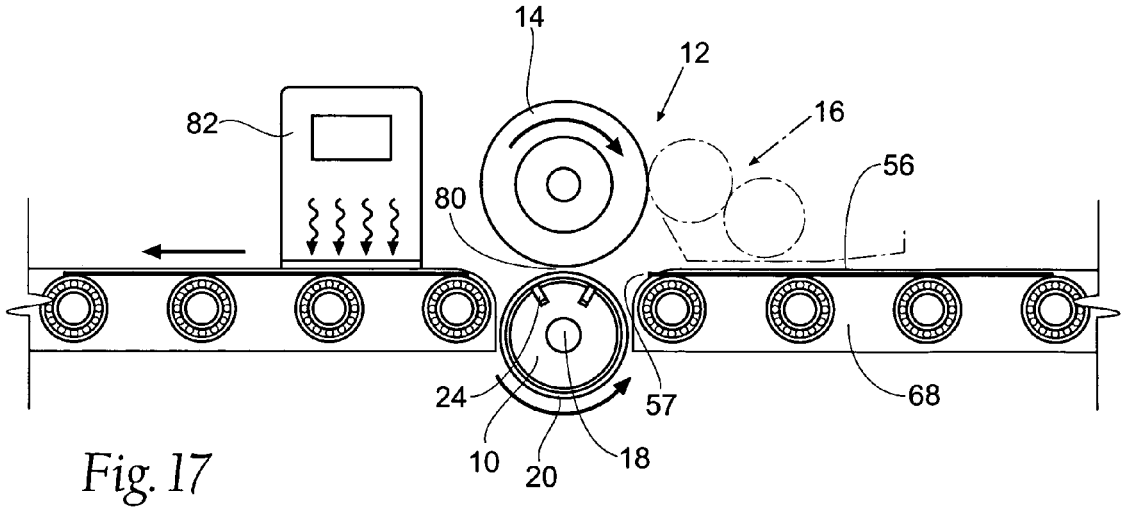
Figure 18:
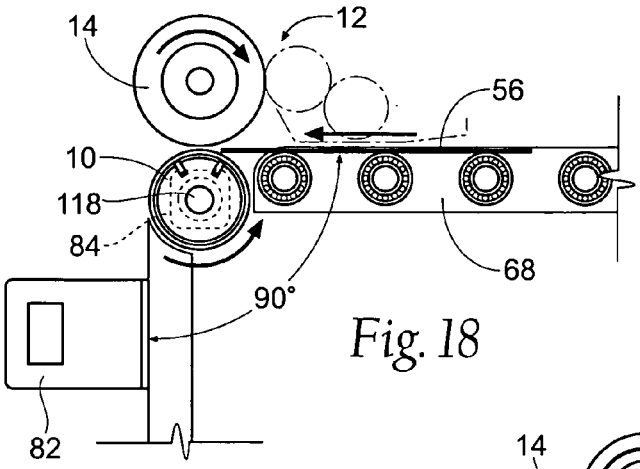
FIGS. 18-21 are diagrammatic views illustrating an alternative method according to the present invention wherein the shaft of the vacuum roller is rotatable to thereby discharge individual coated sheet substrate in a non-linear direction, shown as a right angle.
Figure 19:
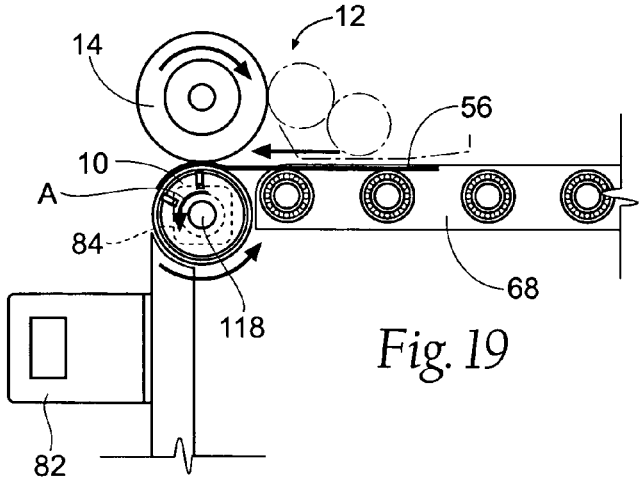
Figure 20:
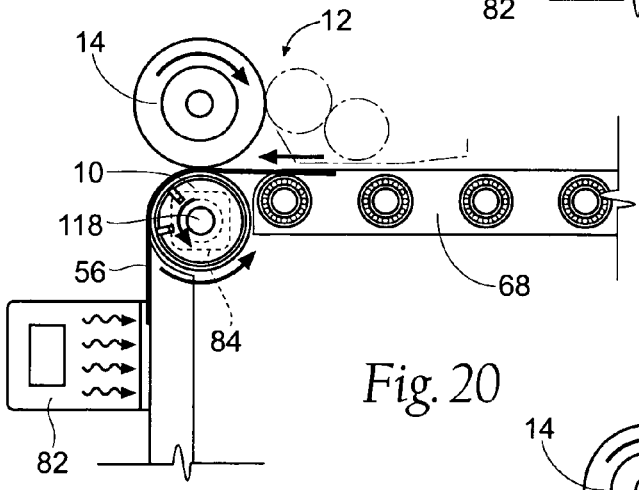
Figure 21:
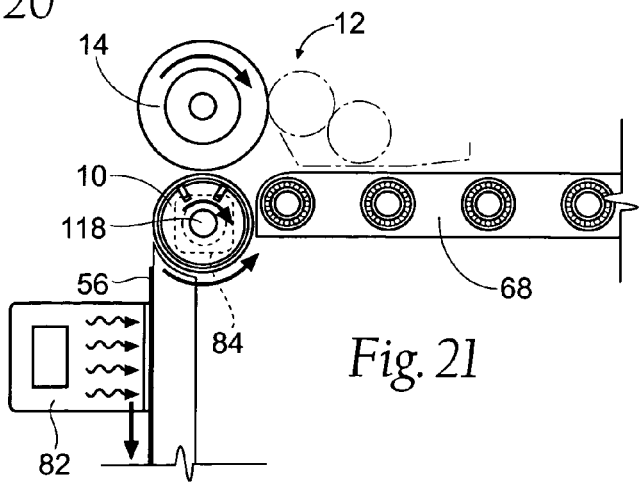
Figure 22:
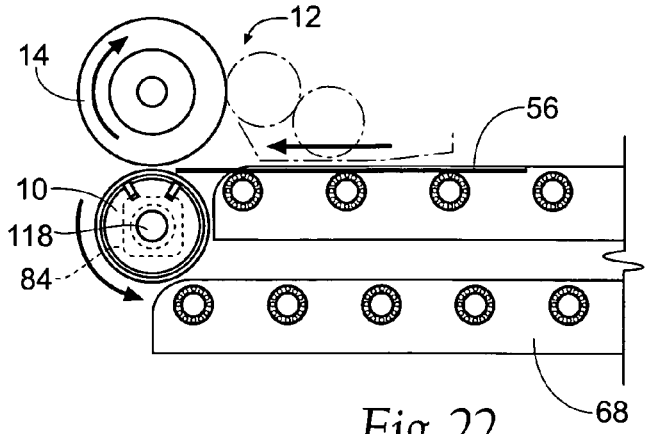
FIGS. 22-25 are diagrammatic views illustrating an alternative method according to the present invention wherein the shaft of the vacuum roller is rotatable to thereby discharge individual coated sheet substrate in a non-linear direction.
Figure 23:
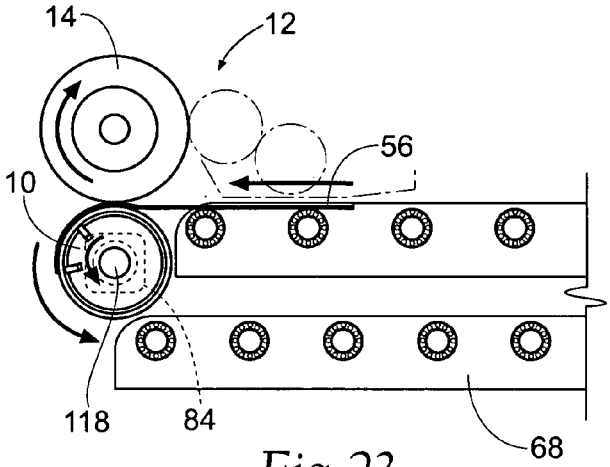
Figure 24:
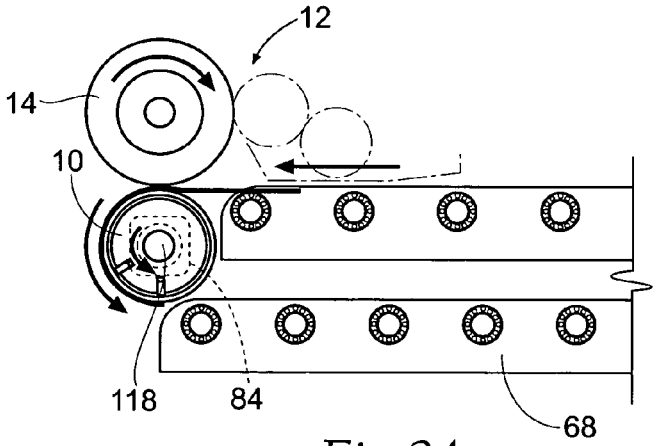
Figure 25:
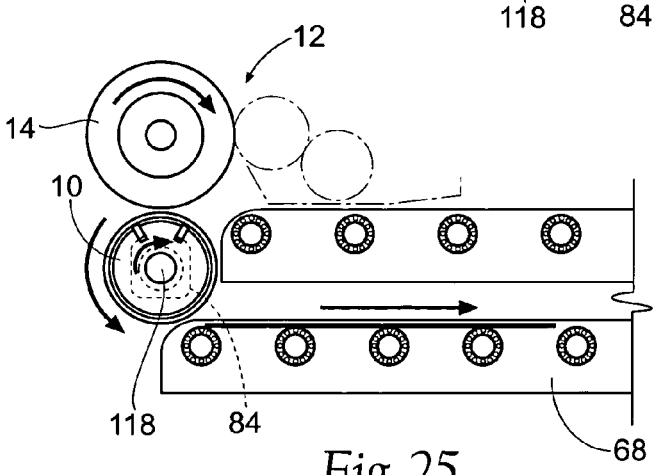

Referring now to the view of FIG. 14, an individual sheet 56 is moved into the nip 80, where it is attracted by the vacuum applied through the rotating sleeve member 20, and assumes the curved configuration modeled by the outer surface 58 of sleeve member 20. As seen in FIGS. 14 and 15, a sheet 56 is attracted to the sleeve member 20 and is retained in a curved configuration as it enters nip 80 and is coated by the continuous transfer surface supplied by the transfer roller 14. With reference to FIG. 16, as the sheet 56 continues past the coating station 12 and away from the transfer roller 14, its leading edge 57 is moved past the chamber 46 and reaches atmospheric pressure, thereby disengaging it from the screen 20. As illustrated in FIG. 17, the coated sheet 56, when coated with a UV curable coating, is next moved to a UV source 82 to thereby cure the coating 70.

Figure 26:
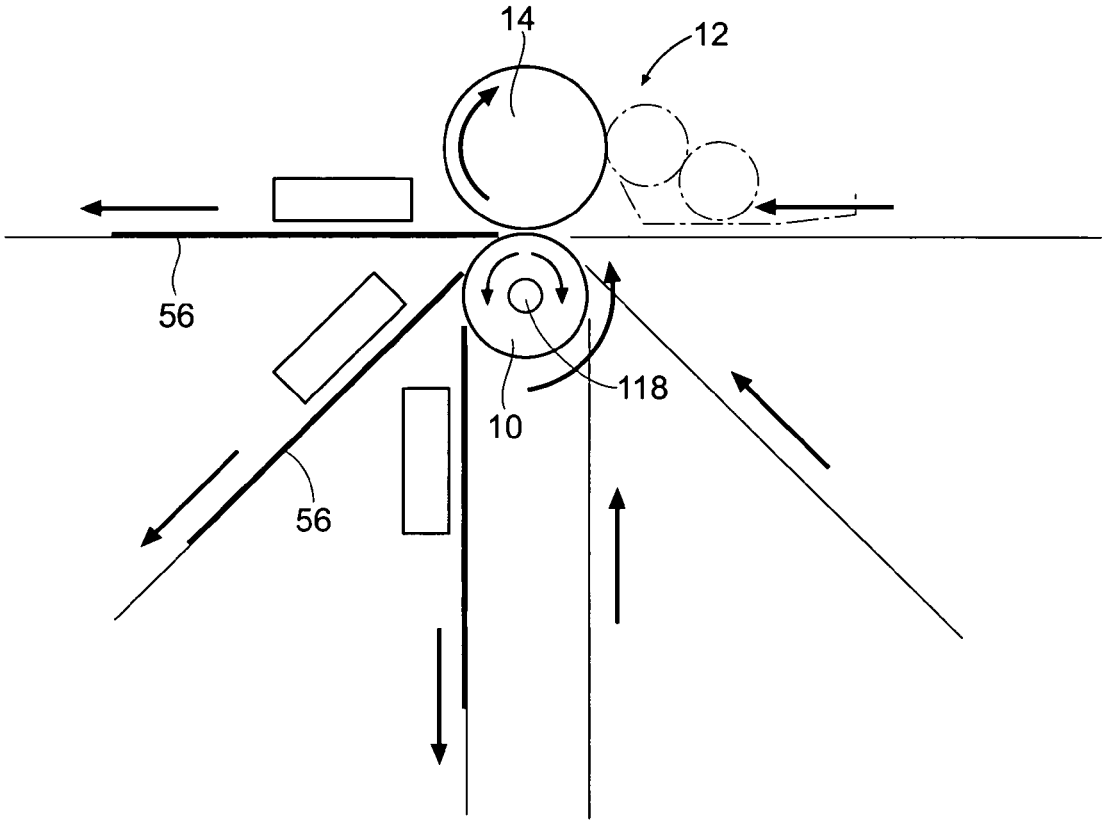
FIG. 26 is a diagrammatic view illustrating an alternative method according to the present invention wherein the shaft of the vacuum roller is rotatable to thereby accept individual sheets from various intake angles and further discharge individual coated sheet substrate in varying directions.
Figure 27:
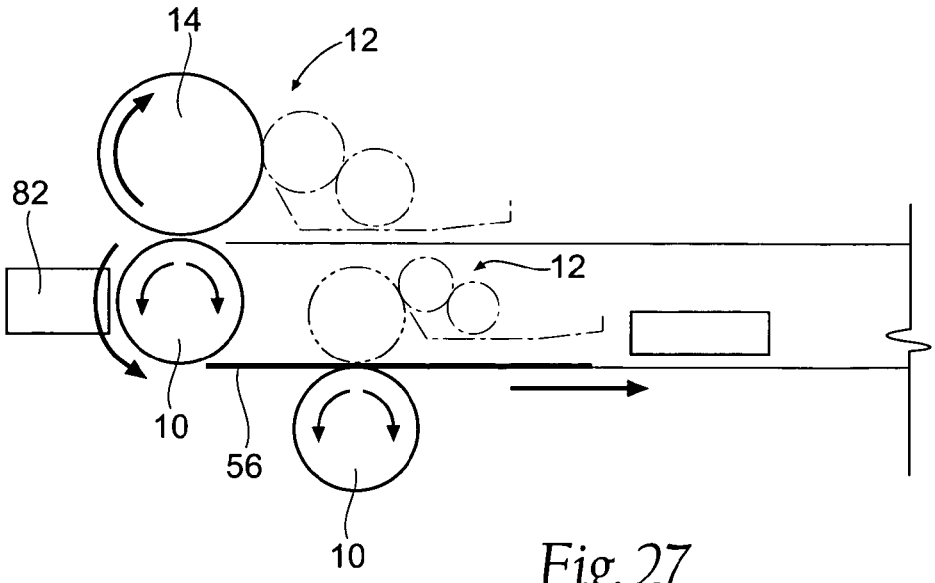
FIG. 27 is a diagrammatic view illustrating an alternative method according to the present invention wherein a plurality of application surfaces and vacuum rollers is used, whereby the individual sheet substrate may be coated on oppositely disposed surfaces.
Figure 28:
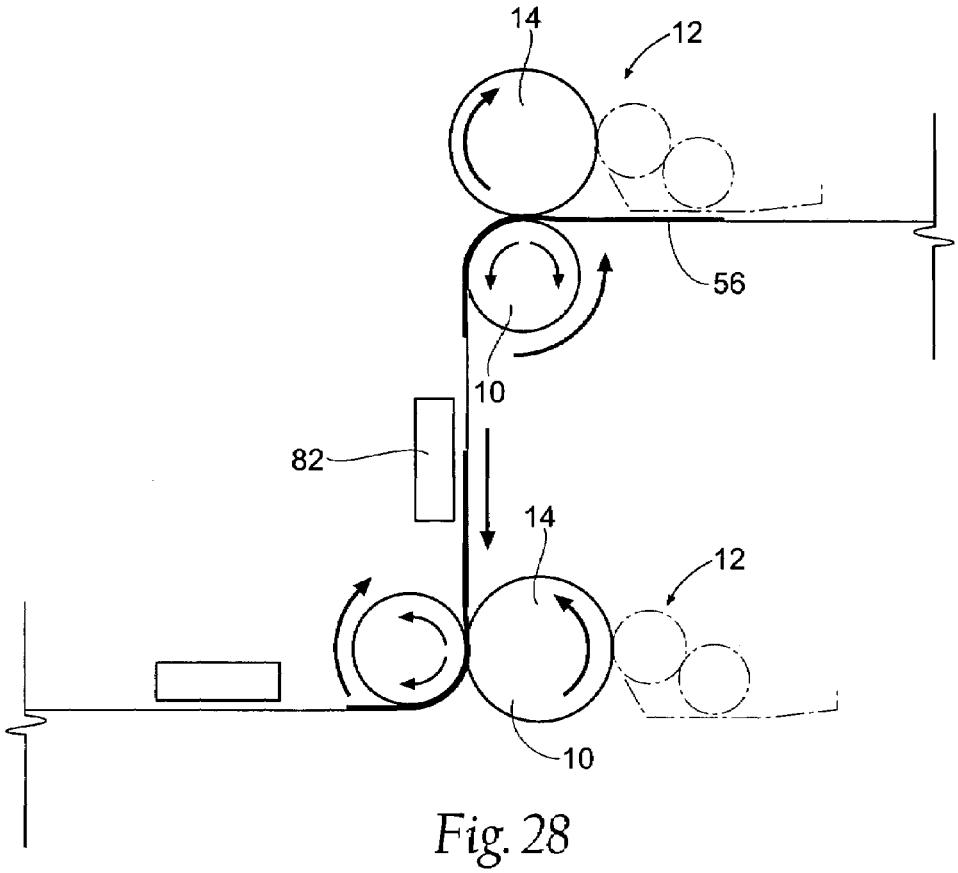
FIG. 28 is a diagrammatic view illustrating another alternative method according to the present invention wherein a plurality of application surfaces and vacuum rollers is used, whereby the individual sheet substrate may be coated on oppositely disposed surfaces.

As may be seen in FIGS. 18-28, the vacuum roller 10 may alternatively include a rotatable supporting shaft 118. As in the previous embodiments, the vacuum roller 10 includes a rotatable-sleeve member 20. At least a portion of the rotatable sleeve member 20 being circumjacent to the rotatable supporting shaft 118, the rotatable sleeve member 20 preferably includes a plurality of perforations 22 arranged in a predetermined pattern (see for example FIG. 2A). As seen in the previous views, the rotatable supporting shaft 118 preferably further includes at least a pair of radially extending, circumferentially spaced barrier members 24, which extend longitudinally of perforations 22 and are normally biased outwardly of the shaft 118 and towards contact with the sleeve member 20. As discussed with reference to previous embodiments, the barrier members 24 define a chamber 46 therebetween and further provide a surface 48 on which the sleeve member 20 rides. The rotatable supporting shaft 118 seen in these views may be operable by a conventional servo motor 84 (shown in phantom), or like means. The selected servo motor 84 is preferably attached to the shaft 118 to provide variable rotational movement for desired angular displacement of the shaft 118. The rotatable supporting shaft 118 permits variation in the pitch of sheet intake and release, allowing "pick and place" of individual sheets 56. That is, as the shaft 118 and chamber 46 rotate toward oncoming sheets 56, the vacuum in the chamber 46 causes a leading marginal edge 57 of an individual sheet 56 to be attracted to the rotating perforated sleeve 20. Variation in the location of the chamber 46 permits individual sheets 56 to be attracted at variable locations along the rotational path of the vacuum roller 10. Additionally, rotation of the shaft 118 in the direction of the arrow A, seen in FIG. 19, allows the reduced pressure in chamber 46 to influence and direct individual sheets 56 beyond the coating station 12, if desired. As seen in FIGS. 18-21, for example, the rotatable shaft 118 permits rotational movement of the barrier members 24 and thereby the chamber 46. As discussed, this movement allows individual sheets 56 to be moved away from the coating station 12 in a non-linear pattern, seen as a 90 degree angle in these views. This feature allows flexibility in line arrangement, and permits arrangements such as the 180 degree angle shown in FIGS. 22-25. Arrangements such as these also permit use of multiple coating stations 12 (see FIGS. 27 and 28), thereby allowing individual sheets 56 to be coated on opposed surfaces. Further, and as seen in FIG. 26, the "pick and place" feature allowed by selected angular displacement of a rotatable supporting shaft 118 permits individual sheets 56 to be received and sorted according to user preference. The rotatable supporting shaft 118 may be further supplied with a hollow bore, as discussed.

Although the Figures are directed to a method and apparatus for coating individual sheets of substrate, it is to be understood that the apparatus disclosed herein may also be utilized in printing applications or any other application using a kiss impression on a tangent. In other examples, the transfer roller 14 may be any applicator roller, such as a printing roller, by way of non-limiting example. Additionally, the nip 80, seen as a continuous nip 80 in the Figures may be an intermittent nip as for example provided by a printing roller for printing only a portion of the substrate.

Figure 30:
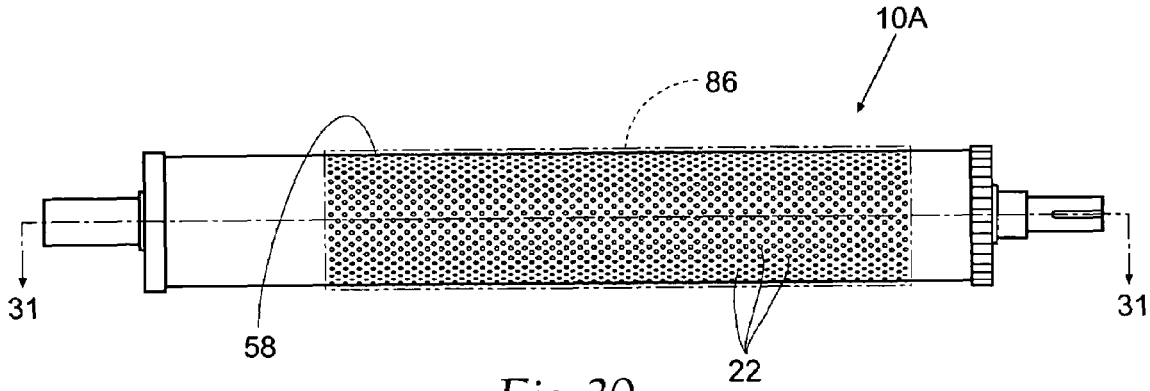
FIG. 30 is a side view of an alternative embodiment vacuum roller according to the present invention.
Figure 31:
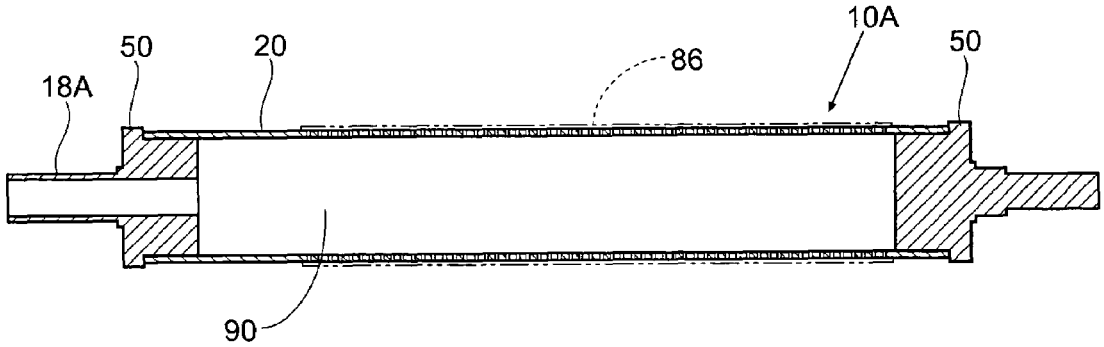
FIG. 31 is a cross sectional view of the vacuum roller illustrated in FIG. 30 and taken along lines 31-31 thereof.
Figure 34:
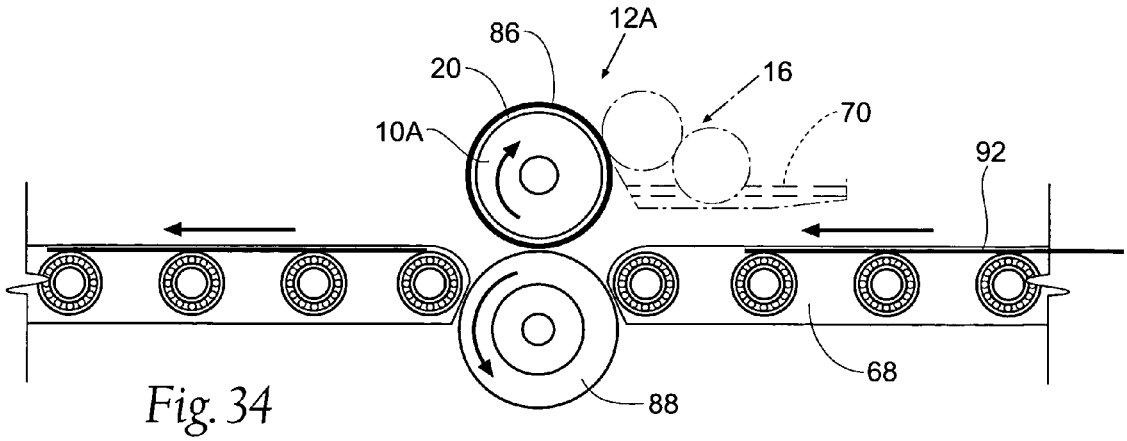
Figure 35:
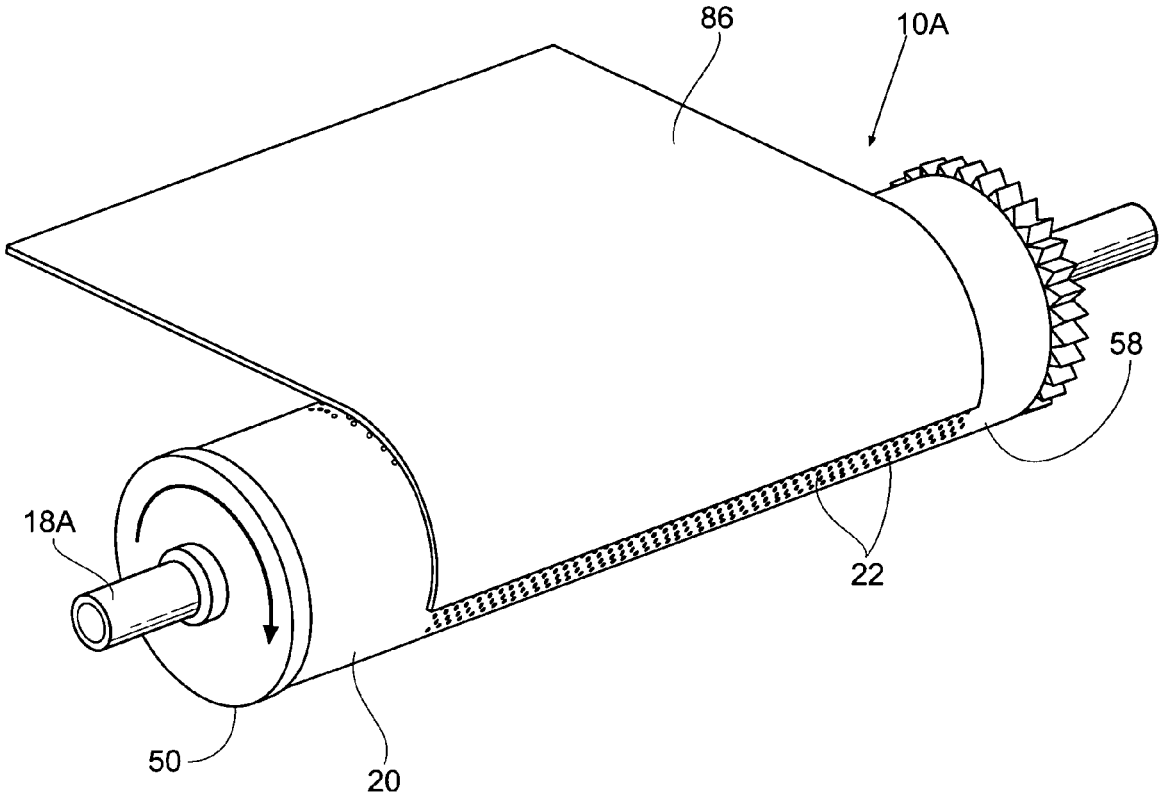
FIG. 35 is a perspective view of the vacuum roller illustrated in FIGS. 30-34 and showing a sheet of substrate, such as a flexible printing die being attracted to, and partially held in a curved configuration against, the vacuum roller.

Yet another embodiment of a vacuum roller 10A may be seen in the view of FIGS. 30, 31 and 35. As illustrated, the vacuum roller 10A may be used to retain a substrate such as the printing plate 86 shown in a curved configuration. The vacuum roller 10A may be used combination with an anvil roller 88 and fountain system 16 (seen in FIGS. 32-34). The vacuum roller 10A preferably includes a hollow supporting shaft 18A and attached sleeve member 20. As in the previously described embodiments, the sleeve member 20 includes a plurality of perforations/apertures 22 arranged in a predetermined manner. The supporting shaft 18A further includes a hollow chamber 90. The vacuum roller 10A and chamber 90 is further provided with end caps 50 to seal opposite ends of the chamber 90, one of which may be geared. Similarly to previous embodiments, the chamber 90 may be connected by a line to a vacuum source, such as a vacuum pump 54 (not seen in these views). The suction generated by the vacuum pump 54 influences the substrate, such as printing plate 86 such that it is held against the outer, curved surface 58 of the sleeve 20 in a curved configuration as the anvil roller 88 and printing plate 86 cooperate to print or emboss a selected web material 92 (see FIGS. 32-34). As seen particularly in FIG. 35, a sheet of substrate, such as a flexible printing die 86 may be attracted to, and held in a curved configuration against, the vacuum roller 10A, the vacuum roller 10A including a supporting shaft 18A, and a sleeve member 20. At least a portion of the sleeve member 20 being circumjacent to the supporting shaft 18A and the sleeve member 20 including a plurality of perforations/ apertures 22, the perforations 22 communicating with the previously mentioned chamber 90 (see particularly FIG. 31), and the chamber being supplied with a source of reduced pressure (not shown. As seen, a sheet of substrate, such as the printing plate 86 shown, may be held in a curved configuration against the sleeve member 20 as influenced by the reduced pressure supplied through the apertures 22.

Figure 32:
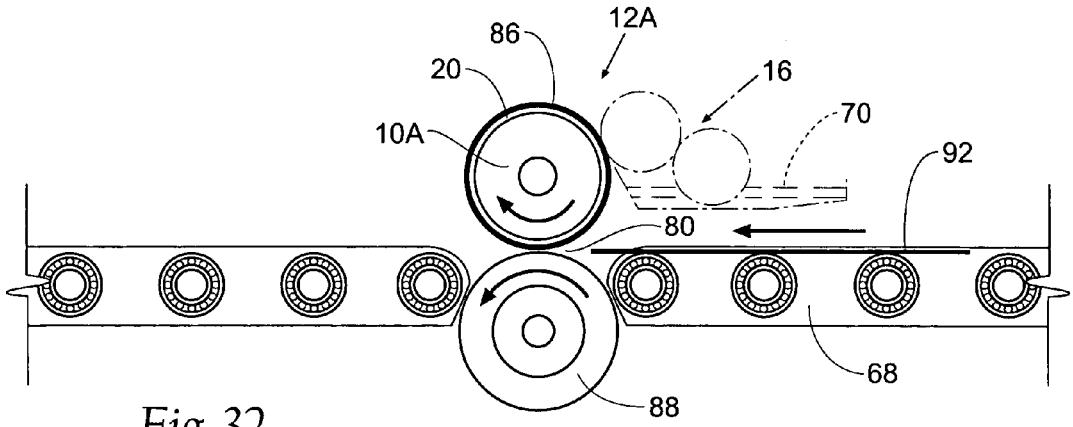
FIGS. 32-34 are diagrammatic views illustrating a method of printing according to the present invention.
Figure 33:
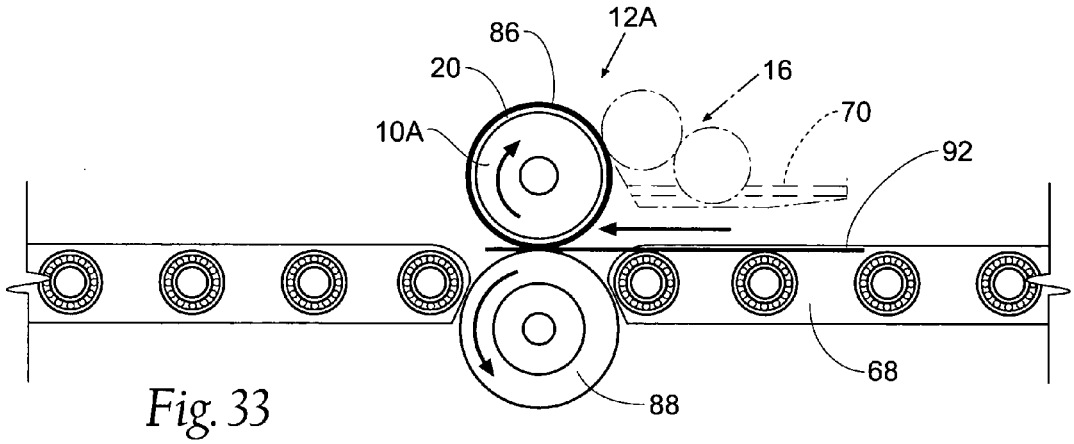

As shown in FIGS. 32-34, a method exemplifying a use of the alternative vacuum roller 10A during printing may be seen. Web 92 to be printed is moved by conveyor 68 or other suitable means along a sheet path and toward a printing station 12A. Printing material 70 is supplied by conventional means, seen as a fountain system 16 (shown in phantom), and as previously discussed. The vacuum roller 10A cooperates with an anvil roller 88 to provide a nip 80. As seen, the nip 80 is arranged to receive the web 92 to be printed. A printing plate 86 is attracted by the vacuum applied through the sleeve member 20, and assumes the curved configuration modeled by the outer surface 58 of sleeve member 20. As seen in FIGS. 32-34, the printing plate 86 is attracted to the sleeve member 20 and is retained in a curved configuration as it rotates during printing.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. An apparatus for treating a surface area of an individual sheet of substrate, said substrate having a selected transverse thickness, with a predetermined material comprising:

a vacuum roller, said vacuum roller including a supporting shaft and a rotatable sleeve member, at least a portion of said sleeve member being circumjacent to said supporting shaft, said rotatable sleeve member including a plurality of perforations arranged in a predetermined pattern, said supporting shaft further including at least a pair of radially extending, circumferentially spaced barrier members providing a first chamber therebetween, said barrier members extending longitudinally of said predetermined perforation pattern;

a transfer roller adapted for treating said surface area, said transfer roller and said vacuum roller cooperating to form a nip therebetween such that a spacing between said transfer roller and said vacuum roller at said nip has a preselected thickness less than the selected transverse thickness of said substrate;

a source of reduced pressure, said source of reduced pressure communicating with said first chamber.

2. The apparatus of claim 1 wherein said transfer roller is a coating roller.

3. The apparatus of claim 1 wherein said transfer roller is a printing roller.

4. The apparatus of claim 1 wherein said transfer roller is adapted to transfer a coating material.

5. The apparatus of claim 1 wherein said transfer roller is adapted to transfer a printing material.

6. The apparatus of claim 1 wherein said transfer roller is adapted to transfer a UV curable coating.

7. The apparatus of claim 1 wherein said perforations are of a predetermined size and shape.

8. The apparatus of claim 1 wherein said supporting shaft is a stationary shaft.

9. The apparatus of claim 1 wherein said supporting shaft is capable of rotational movement.

10. The apparatus of claim 9 further including three radially extending, spaced apart barrier members extending longitudinally of said predetermined perforation pattern to thereby provide a second chamber.

11. The apparatus of claim 10 wherein said supporting shaft includes a bore, said bore communicating with at least one channel, said at least one channel communicating with said second chamber.

12. The apparatus of claim 11 wherein said bore is supplied with a source of increased pressure.

13. The apparatus of claim 1 further including biasing means normally biasing said radially extending barrier members outwardly of said supporting shaft and towards contact with said sleeve member.

14. The apparatus of claim 1 wherein said supporting shaft includes a bore, said bore communicating with at least one channel, said at least one channel communicating with said first chamber.

15. The apparatus of claim 14 wherein said bore is supplied with said source of reduced pressure.

16. The apparatus of claim 1 wherein said supporting shaft includes a bore, said bore communicating with at least one channel, said at least one channel communicating with said barrier members, and wherein said bore is supplied with a source of increased pressure to thereby bias said barrier members outwardly of said bore.

17. A method for producing coated sheets of substrate comprising:

sequentially feeding individual sheets of substrate each having a selected transverse thickness, a first side and a second, oppositely disposed side from a stack onto a sheet path and conveying each of said individual sheets along said sheet path in a machine direction;

providing a vacuum roller and continuous coating roller in cooperating relationship so as to form a nip such that a spacing between said vacuum roller and said continuous coating roller at said nip has a preselected thickness less than the selected transverse thickness of said substrate, said vacuum roller including a supporting shaft and a rotatable sleeve member, at least a portion of said sleeve member being circumjacent to said supporting shaft, said rotatable sleeve member including a plurality of perforations arranged in a predetermined pattern, said supporting shaft further including at least a pair of radially extending, circumferentially spaced barrier members providing a chamber therebetween, said barrier members extending longitudinally of said predetermined pattern;

inserting a leading edge of at least one sheet of substrate into said nip;

applying a source of reduced pressure to said chamber so as to attract said leading edge and said second side to said sleeve member;

retaining said sheet in a curved configuration while applying coating material to said first side to provide a coated sheet; and moving said leading edge past said chamber.

18. The method of claim 17 further including curing said coated sheet as it continues to be conveyed along said sheet path so as to form a cured coated sheet.

19. The method of claim 17 further including providing rotational movement to said shaft.

20. The method of claim 19 further including providing three radially extending circumferentially spaced barrier members so as to provide a first chamber and a second chamber.

21. The method of claim 20 further including providing said supporting shaft with a bore, said bore communicating with at least one channel, said at least one channel communicating with said second chamber.

22. The method of claim 21 further including supplying said bore with a source of increased pressure.

23. The method of claim 17 further providing biasing means normally biasing said radially extending barrier members outwardly of said supporting shaft and towards contact with said sleeve member.

24. The method of claim 17 further providing said supporting shaft with a bore, said bore communicating with at least one channel, said at least one channel communicating with said first chamber.

25. The method of claim 24 further including supplying said bore with said source of reduced pressure.

26. The method of claim 17 further including providing said supporting shaft with a bore, said bore communicating with at least one channel, said at least one channel communicating with said barrier members, and wherein said bore is supplied with a source of increased pressure to thereby bias said barrier members outwardly of said bore.

* * * * *